US006358075B1

(12) United States Patent
Tischner

(10) Patent No.: US 6,358,075 B1
(45) **Date of Patent: *Mar. 19, 2002**

(54) MATING ALIGNMENT GUIDE

(75) Inventor: John J. Tischner, St. Petersburg, FL (US)

(73) Assignee: Raytheon Company, Lexington, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/170,832

(22) Filed: Oct. 13, 1998

(51) Int. Cl.[7] ..... H01R 13/64
(52) U.S. Cl. ..... 439/248
(58) Field of Search ..... 439/247, 248, 439/378, 563–565, 570, 620

(56) References Cited

U.S. PATENT DOCUMENTS 5,385,481 A * 1/1995 Kotyuk ..... 439/378
5,575,673 A 11/1996 Dahlem et al. ..... 439/248
5,622,511 A * 4/1997 Jarrett ..... 439/248
5,649,834 A 7/1997 Allison et al. ..... 439/247
5,690,504 A 11/1997 Scanlan et al. ..... 439/378
6,033,247 A * 3/2000 Gregory ..... 439/248

FOREIGN PATENT DOCUMENTS

EP 0 345 934 4/1989 ..... H01R/13/631

* cited by examiner

*Primary Examiner*—Gary Paumen
*Assistant Examiner*—Phuong Nguyen
(74) *Attorney, Agent, or Firm*—Baker Botts L.L.P.

(57) ABSTRACT

A mating alignment guide comprises a float plate having a first alignment device. The float plate operates to couple a connector to a chassis. A connector mate is coupled to a backplane, and a second alignment device is operable to be coupled to the backplane. The first alignment device operates to engage the second alignment device and aligns the connector with the connector mate.

8 Claims, 1 Drawing Sheet

MATING ALIGNMENT GUIDE

TECHNICAL FIELD OF THE INVENTION

The present invention relates generally to coupling devices, and more particularly to a mating alignment guide.

BACKGROUND OF THE INVENTION

Electronic systems are used in nearly all aspects of modern technology, and range in complexity from a toaster to a communications satellite. Electronic systems are often constructed in modular form from a number of detachable electronic modules. The electronic modules are interconnected within the electronic system and each electronic module often performs a specific function. For example, an automotive electronic system may include a microprocessor module, multiple engine sensor modules, multiple engine control modules, and the like. In this example, the microprocessor module receives sensor data from each of the engine sensor modules, evaluates the sensor data, and communicates command signals to the engine control modules to adjust the operating parameters of the engine.

The electronic modules are generally interconnected to the other components of the electronic system by cable assemblies. The detachable modular form of the electronic system often necessitates the use of a detachable cable coupling within the cable assembly to allow the individual module to be removed. Many conventional cable couplings utilize a pin and pin receptacle configuration for detachably interconnecting the cable assembly. In addition, many conventional cable couplings include precision alignment guides to align the pins to the pin receptacles. Installation of the electronic module is accomplished by mated together the components of the cable coupling, such as the precision alignment guides and the pins and pin receptacles.

In some applications, access to assemble the cable coupling is limited. In these applications, the components of the cable coupling are often assembled by blind mating the components together. Blind mating the precision alignment guides together is generally very time intensive, and often results in damage to the components of the cable coupling, such as the pins. In addition, it is generally difficult to determine if the cable coupling has been assembled correctly and that the pins fully engage the pin receptacles so as to not disengage during operation.

SUMMARY OF THE INVENTION

Accordingly, a need has arisen in the art for a mating alignment guide. The present invention provides a mating alignment guide that substantially reduces or eliminates problems associated with prior systems and methods.

In accordance with one embodiment of the present invention, a mating alignment guide comprises a float plate and alignment pins. The float plate operates to couple a connector to a chassis. The float plate comprises alignment passages. The mating alignment guide also comprises a second alignment device operable to be coupled to a backplane. The backplane also includes a connector mate. The first alignment device operates to engage the second alignment device to align the connector with the connector mate.

In accordance with another embodiment of the present invention, a mating alignment guide for an electronic system comprises an electronic module having a chassis with a connector cutout and a connector disposed, in part, within the connector cutout. A connector mate is coupled to a backplane. The mating alignment guide comprises a float plate that restrains the movement of the connector with reference to the chassis, and an alignment operable to align the float plate to the backplane such that the connector is coupled to the connector mate.

In accordance with another embodiment of the present invention, a float plate for aligning a connector and a connector mate is provided. In a particular embodiment, the float plate comprises a float plate cavity sized to fit the connector and restrain the connector. In addition, the float plate comprises an alignment device operable to engage a complementary alignment device associated with the connector mate to align the connector with the connector mate.

The present invention provides several technical advantages. For example, the mating alignment guide allows the electronic module to be blind mated to the backplane with fewer complications, such as damaged connectors, than many conventional alignment systems. Accordingly, the electronic system can be constructed less expensively and with greater reliability.

Another technical advantage of the present invention is that the mating alignment guide pre-aligns the connector and the connector mate. In addition, the float plate allows limited movement of the connector to facilitate assembly of the connector and the connector mate. Accordingly, the connector and the connector mate can be assembled with fewer complications, and without damage to either the connector or the connector mate, thereby saving money and time.

An additional technical advantage of the present invention is that the float plate restrains movement of the connector with reference to the chassis, thereby helping to minimize the connector from becoming disengaged from the connector mate during operation. Accordingly, the operational reliability of the electronic system is improved.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following description taken in conjunction with the accompanying drawings, wherein like reference numerals represent like guides, in which.

DETAILED DESCRIPTION OF THE INVENTION

Figure 1:
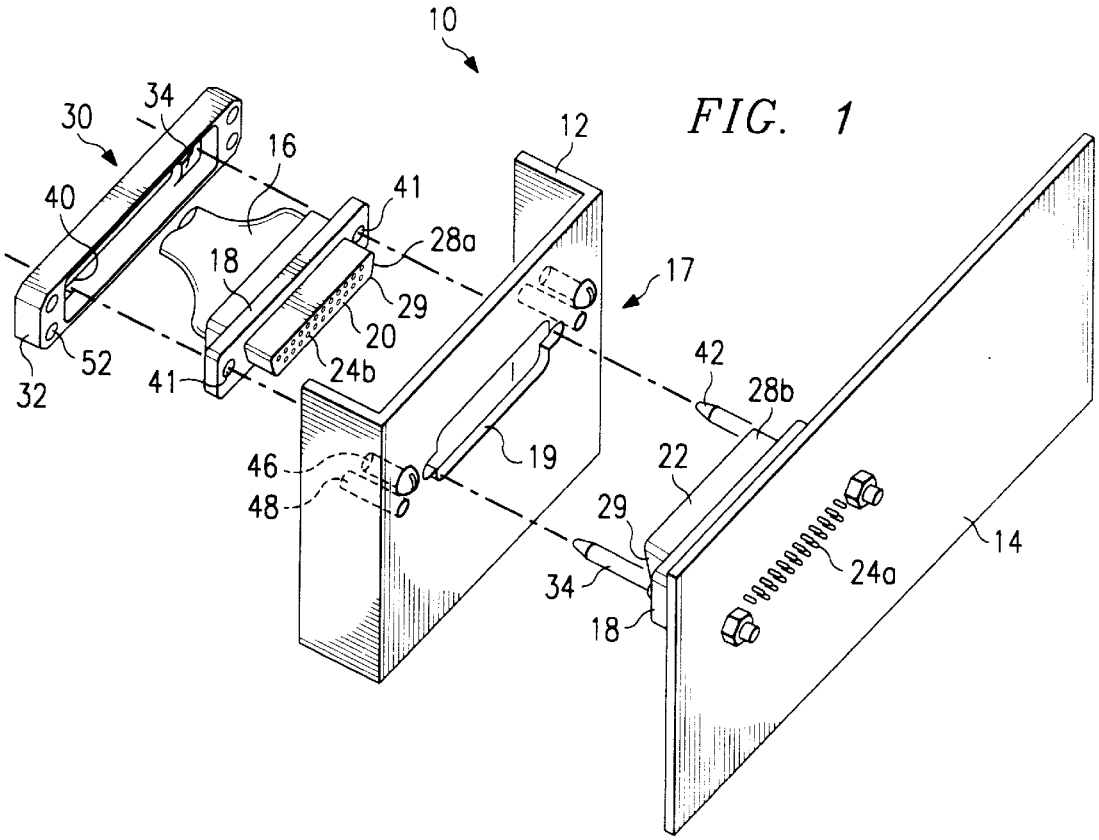
FIG. 1 is an exploded view of selected parts of an electronic system having a mating alignment guide for aligning an electronic module to a backplane in accordance with the present invention.
Figure 2:
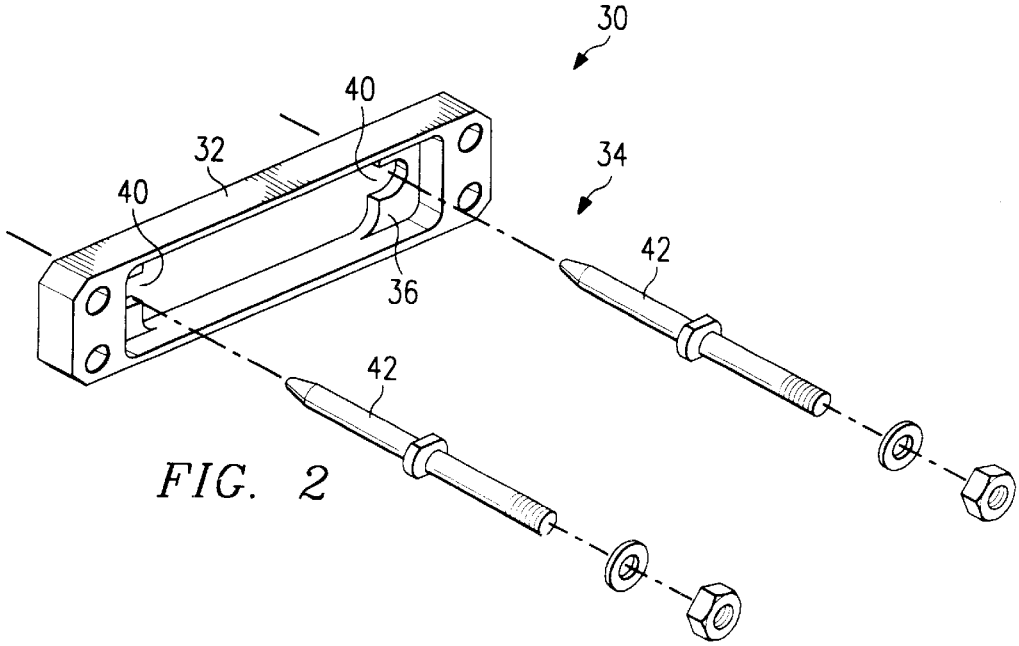
FIG. 2 is an exploded view of the mating alignment guide of FIG. 1 in accordance with the present invention.

FIGS. 1 and 2 illustrate a mating alignment guide. As described in greater detail below, the mating alignment guide comprises a float plate and alignment pins. The float plate comprises alignment passages that operate to engage the alignment pins and align a connector to a connector mate. In addition, the float plate may allow limited movement of the connector with respect to a chassis to facilitate assembly of the connector and connector mate. In particular, the mating alignment guide allows the connector and connector mate to be blind mated with relative ease as compared to some conventional guide systems.

Although the mating alignment guide is described with respect to an electronic system, the mating alignment guide may be used in other applications without departing from the scope of the present invention. For example, the mating alignment guide may be utilized in hydraulic and pneumatic systems to align the respective couplings.

FIG. 1 is an exploded view of selected parts of an electronic system 10. The electronic system 10 comprises at least one electronic module 12 (selected parts shown) that is coupled to a backplane 14. A cable assembly 16 provides a communication link between the electronic module 12 and other components of the electronic system 10 (not expressly shown).

The electronic system 10 is generally constructed from several different electronic modules 12 that perform different operations- The electronic modules 12 that comprise the electronic system 10 may be any suitable type of electronic device that communicates with the other components of the electronic system 10 through the cable assembly 16. For example, in one utilization of the present invention, the electronic system 10 comprises a computer control system located in an aircraft. The computer control system includes one or more electronic modules 12, such as central processing units, radar systems, sensor modules, control modules, and the like, that are interconnected to form the computer control system. Individual electronic modules 12 can be removed and replaced without removal of the entire electronic system 10. Accordingly, the electronic system 10 can be maintained and upgraded with relative ease by replacement of the individual electronic modules 12.

The electronic module 12 generally includes a chassis 17 that encases and protects the electronic components within the electronic module 12. The cable assembly 16 is coupled to the chassis 17 and the backplane 14. The chassis 17 often includes a connector cutout 19 that allows the cable assembly 16 to pass through the chassis 17.

The backplane 14 provides a support structure for interconnecting the cable assembly 16 between the electronic module 12 and the other components of the electronic system 10. In particular, as will be discussed in greater detail below, the cable assembly 16 is removably coupled to both the chassis 17 of the electronic module 12 and the backplane 14. In many applications, the backplane 14 also forms a portion of a rack assembly (not expressly shown) that operates to restrain the electronic module 12 within the rack assembly.

As discussed previously, the cable assembly 16 is removably coupled to the chassis 17 and the backplane 14. The cable assembly 16 generally comprises a number of individual wires that provide a communications link and power to the electronic module 12. It will be understood that the cable assembly 16 may comprise any suitable type of communication device. For example, cable assembly 16 may comprise a fiber optic line, or the like.

The cable assembly 16 includes a two-part cable coupling 18 that can be disconnected to allow removal of the electronic module 12 from the backplane 14. Specifically, the cable coupling 18 comprises a connector 20 and a connector mate 22. In one embodiment, the connector 20 is coupled to the chassis 17 and the connector mate 22 is coupled to the backplane 14. Although FIG. 1 illustrates the connector 20 as a male type connector and the connector mate 22 as a female type connector, it will be understood that the connector 20 and the connector mate 22 may be otherwise suitably configured without departing from the scope of the present invention.

The connector 20 and the connector mate 22 include complementary junction devices 24*a* and 24*b* that couple the electrical wires in the connector 20 to the electrical wires in the connector mate 22. For example, as illustrated in FIG. 1, the complementary junction devices 24*a* and 24*b* comprise a number of pins 24*a* (not expressly shown in the connector mate 22) that engage a corresponding number of pin receptacles 24*b* in the connector 20. The complementary junction devices 24*a* and 24*b* are often relatively delicate and prone to damage from misalignment. To provide precision alignment, the connector 20 and the connector mate 22 generally include complementary precision alignment guides 28*a* and 28*b*. The complementary precision alignment guides 28*a* and 28*b* provide precision alignment for mating the complementary junction devices 24*a* and 24*b*, and are otherwise known as connector shells. For example, as illustrated in FIG. 1, the cable coupling 18 is a D-type coupling having male and female type precision alignment guides 28*a* and 28*b* that cooperate to align the complementary junction devices 24*a* and 24*b*. In particular, the male and female type precision alignment guides 28*a* and 28*b* come into engagement prior to the engagement of the complementary junction devices 24*a* and 24*b*. In addition, the connector 20 and the connector mate 22 also generally include an indexing guide 29 that allows the connector 20 and the connector mate 22 to only be mated in a single orientation. For example, the male and female precision alignment guides of the D-type coupling have a somewhat D-shaped configuration that forms the indexing guide 29, and only allows assembly of the cable coupling 18 in one orientation.

In many applications, such as in an aircraft, space is limited and one or more of the electronic modules 12 must be blind mated to the respective backplane 14. In such applications, physical access for mating the connector 20 to the connector mate 22 is similarly limited, and is often accomplished without viewing the connection of the cable coupling 18, thus the term "blind" mating. In these applications, it is difficult to align the complementary precision alignment guides 28*a* and 28*b* of the connector 20 and the connector mate 22, respectively.

FIG. 2 is an exploded view of one embodiment of a mating alignment guide 30. Referring to FIGS. 1 and 2, the mating alignment guide 30 aligns the connector 20 with the connector mate 22. As described in greater detail below, the mating alignment guide 30 comprises a float plate 32 and a set of alignment pins 34.

The float plate 32 operates to restrain movement of the connector 20 with reference to the chassis 17 of the electronic module 12. In one embodiment, the float plate 32 comprises a float cavity 36 sized to fit the connector 20. In a particular embodiment, the float cavity 36 allows limited movement of the connector 20 within the float cavity 36. In this embodiment, the limited movement of the connector 20 provides a limited degree of freedom to facilitate mating of the complementary precision alignment guides 28*a* and 28*b* on the connector 20 and the connector mate 22, respectively. In addition, the float plate 32 comprises alignment openings 40 that correspond to the alignment pins 34.

As best illustrated in FIG. 2, each alignment pin 34 is generally threaded and includes a threaded fastener, such as a nut, for coupling each alignment pin 34 to the backplane 14. In a particular embodiment, the alignment pins 34 also restrains the connector mate 22 to the backplane 14, as illustrated in FIG. 2. It will be understood that the alignment pins 34 may comprise other suitable alignment devices without departing from the scope of the present invention.

The alignment pins 34 have a complementary configuration with respect to the alignment openings 40, and operate to generally align the connector 20 with the connector mate 22. In particular, the alignment openings 40 engage the alignment pins 34 prior to the connector 20 engaging the connector mate 22. In addition, the connector 20 may include connector openings 41, such that the alignment pins 34 engage the connector openings 41 prior to the connector

20 engaging the connector mate 22. Accordingly, the complementary precision alignment guides, 28*a* and 28*b*, on the connector 20 and the connector mate 22, respectively, are easily mated together without damaging the components of the complementary junction devices 24*a* and 24*b*. Furthermore, the alignment openings 40 and the alignment pins 34 allow blind mating of the connector 20 to the connector mate 22. Accordingly, the connector 20 and the connector mate 22 are blind mated with fewer complications and greater reliability than many conventional methods and systems.

In another embodiment, as illustrated in FIG. 1, the mating alignment guide 30 also includes a two-part float plate alignment device 46. In a particular embodiment, the float plate alignment device 46 comprises a set of chassis alignment pins 48 coupled to the chassis 17, and a corresponding number of alignment apertures 52 in the float plate 32. The alignment apertures 52 are the complement of the chassis alignment pins 48, and operate to align the float plate 32 with the connector cutout 19 of the chassis 17. It will be understood that the float plate alignment device 46 may comprise other suitable alignment devices without departing from the scope of the present invention.

Although the present invention has been described in several embodiments, various changes and modifications may be suggested to one skilled in the art. It is intended that the present invention encompasses such changes and modifications that fall within the scope of the appended claims.

What is claimed is:

1. A mating alignment guide for alignment of a connector with a mating connector prior to coupling thereto, comprising:

a connector;

a backplate;

a mating connector supported on the backplate;

one or more alignment pins fastened to the backplate, said one or more alignment pins extending from the backplate a distance sufficient to align the connector before engagement with the mating connector; and a float plate comprising:

a float cavity comprising an opening, wherein the size of the opening allows two-dimensional floating movement of the connector relative to the float plate; and one or more openings to engage the one or more alignment pins; and the connector received in the opening of the float cavity, the connector having two-dimensional movement in the opening, whereby the alignment pins engage the alignment openings to guide the connector into alignment with the mating connector prior to the connector coupling to the mating connector.

2. A mating alignment guide for alignment of a connector with a mating connector prior to coupling thereto, comprising:

a backplate supporting the mating connector;

one or more alignment pins fastened to the backplate, said one or more alignment pins extending from the backplate a distance sufficient to align the connector before engagement with the mating connector; and a float plate comprising:

a float cavity comprising an opening, the opening configured to allow two-dimensional movement of the connector relative to the float plate in a preferred orientation; and one or more alignment openings to engage the one or more alignment pins; and the connector received within the opening of the float cavity, the connector having two-dimensional movement in the opening, whereby the alignment pins engage the alignment openings to guide the connector into alignment with the mating connector prior to the connector coupling to the mating connector.

3. A mating alignment guide, comprising:

a back plate;

a mating connector supported on the back plate;

one or more alignment pins fastened to the back plate;

a float plate comprising:

a float cavity comprising an opening, wherein the size of the opening allows two-dimensional floating movement of a connector received therein relative to the float plate; and one or more alignment openings to engage the one or more alignment pins; and a connector received within the opening of the float cavity, the connector having two-dimensional movement in the opening, whereby the alignment pins engage the alignment openings to guide the connector into alignment with the mating connector prior to the connector coupling to the mating connector.

4. The mating alignment guide of claim 3, further comprising a float plate alignment device to align the float plate to an electronic system chassis.

5. The mating alignment guide of claim 4, wherein the float plate alignment device comprises a plurality of chassis alignment pins coupled to the chassis, and a plurality of alignment apertures disposed in the float plate to engage the chassis alignment pins and align the float plate and connector to a connector cutout in the chassis.

6. A mating alignment guide, comprising a back plate;

a mating connector;

one or more alignment pins for fastening the mating connector to the back plate;

a float plate comprising:

a float cavity comprising an opening, wherein the size of the opening allows two-dimensional floating movement of a connector received therein relative to the float plate; and one or more alignment openings to engage the one or more alignment pins; and a connector received within the opening of the float cavity, the connector having two-dimensional movement in the opening, whereby the alignment pins engage the alignment openings to guide the connector into alignment with the mating connector prior to the connector coupling to the mating connector.

7. A mating alignment guide as set forth in claim 6 wherein said connector further comprises one or more connector openings to engage the one or more alignment pins prior to the alignment opening of the float plate engaging the one or more alignment pins, the connector opening establishing an initial alignment of the mating connector with the mating connector prior to a final alignment by the engagement of the one or more alignment openings with the one or more alignment pins.

8. The mating alignment guide of claim 7 wherein the connector has a substantially rectangular configuration, further comprising:

said float plate comprises a substantially rectangular shape float cavity to receive the connector in a preferred orientation.

* * * * *

UNITED STATES PATENT AND TRADEMARK OFFICE

CERTIFICATE OF CORRECTION

PATENT NO. : 6,358,075 B1
DATED : March 19, 2002
INVENTOR(S) : John J. Tischner

It is certified that error appears in the above-identified patent and that said Letters Patent is hereby corrected as shown below:

Column 3,
Line 14, after "operation", delete "-" and insert -- . --.

Column 6,
Line 33, after "comprising", insert -- : --.
Line 56, after "the", delete "mating".

Signed and Sealed this

First Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,358,075 B1
APPLICATION NO. : 09/170832
DATED : March 19, 2002
INVENTOR(S) : John J. Tischner It is certified that error appears in the above-identified patent and that said Letters Patent is hereby corrected as shown below:

Column 1:
Before the "TECHNICAL FIELD OF THE INVENTION" section, at Line 3 insert:

-- GOVERNMENT INTEREST
This invention was made with Government support under contract number N00025-92-C-05230 awarded by the Naval Sea System Command. The Government has certain rights in this invention. --.

Signed and Sealed this

Fifth Day of June, 2007

JON W. DUDAS
*Director of the United States Patent and Trademark Office*